United States Patent [19]

Moore

[11] Patent Number: 5,031,600

[45] Date of Patent: Jul. 16, 1991

[54] ARCHERY BOWSTRING RELEASE

[76] Inventor: Gary E. Moore, 1200 Calhoun Rd., Aberdeen, Wash. 98520

[21] Appl. No.: 495,882

[22] Filed: Mar. 19, 1990

[51] Int. Cl.[5] ..... F41B 5/00

[52] U.S. Cl. ..... 124/35.2

[58] Field of Search ..... 124/35.2, 90

[56] References Cited

U.S. PATENT DOCUMENTS

| | | | |
|---|---|---|---|
| 4,083,348 | 4/1978 | Fletcher | 124/35.2 |
| 4,173,210 | 11/1979 | Napier | 124/35.2 |
| 4,249,507 | 2/1981 | Marra | 124/35.2 |
| 4,316,443 | 2/1982 | Giacomo | 124/35.2 |
| 4,498,448 | 2/1985 | Fletcher | 124/35.2 |
| 4,527,536 | 7/1985 | Smith | 124/35.2 |
| 4,539,968 | 9/1985 | Garvison | 124/35.2 |
| 4,823,761 | 4/1989 | Lewis | 124/35.2 |
| 4,969,448 | 11/1990 | Beyer | 124/35.2 |

*Primary Examiner*—Randolph A. Reese
*Assistant Examiner*—Jeffrey L. Thompson
*Attorney, Agent, or Firm*—Olson & Olson

[57] ABSTRACT

An archery bowstring release includes a body mounting a bowstring retainer hook member and a hook release lever releasably engaging the hook member and movable in the release direction by the resilient pressure of a spring interposed between the body and the hook release lever. In one embodiment the hook release lever is held in hook retaining position by thumb pressure of an archer's hand. In another embodiment the hook release lever is controlled by a trigger lever movable between a cocked position in which the hook release lever is held in hook retaining position and a triggered position in which the hook release member is disengaged from the trigger lever for movement to release the hook member. In still another embodiment a whisk hammer and fulcrum lever are interposed between the trigger lever and hook release lever, and an adjustable spring tension may be applied to the whisk hammer to vary the resistive pressure applied by the whisk hammer to the trigger lever.

10 Claims, 2 Drawing Sheets

ARCHERY BOWSTRING RELEASE

BACKGROUND OF THE INVENTION

This invention relates to bowstring release devices, and more particularly to a bowstring release device of improved sensitivity.

Bowstring release devices have been provided heretofore to avoid the problems incident to the use of the fingers of the hand in pulling a bowstring to full draw. However, prior releases are characterized by the disadvantages of slowness and inadequate sensitivity of release point, contributing adversely to reduced performance and accuracy.

Exemplary of such prior bowstring releases are those disclosed in U.S. Pat. Nos. 3,845,752; 3,916,868; 3,954,095; 4,009,703; 4,022,181; 4,066,060; 4,083,348; 4,156,417; 4,170,216; 4,173,210; 4,249,507; 4,316,443; 4,391,263; 4,392,475; 4,489,705; 4,498,448; 4,625,705; and 4,665,886.

SUMMARY OF THE INVENTION

In its broad concept, this invention provides an archery bowstring release construction in which a bowstring retainer hook is held in locked position, in which the hook secures a bowstring for draw, by a hook release lever which is spring loaded to be urged resiliently in the direction to unlock the hook and release the bowstring.

It is by virtue of the foregoing basic concept that the principal objective of this invention is achieved; namely, to overcome the aforementioned limitations and disadvantages of prior bowstring releases.

Another objective of this invention is to provide a bowstring release of the class described in a variety of structural forms which range from simplified, economical construction for basic performance to more complex constructions which provide greater sensitivity of hook release.

A further object of this invention is to provide a bowstring release of the class described which provides adjustable sensitivity of hook release by providing adjustment of the magnitude of movement of a trigger to release position.

A still further objective of this invention is the provision of a bowstring release of the class described which provides adjustable sensitivity of hook release by adjusting the magnitude of finger pressure required to move a trigger to release position.

Another objective of this invention is the provision of a bowstring release of the class described which accommodates use by both right and left-handed archers.

The foregoing and other objects and advantages of this invention will appear from the following detailed description, taken in connection with the accompanying drawings of preferred embodiments.

DESCRIPTION OF THE PREFERRED EMBODIMENTS

Figure 1:
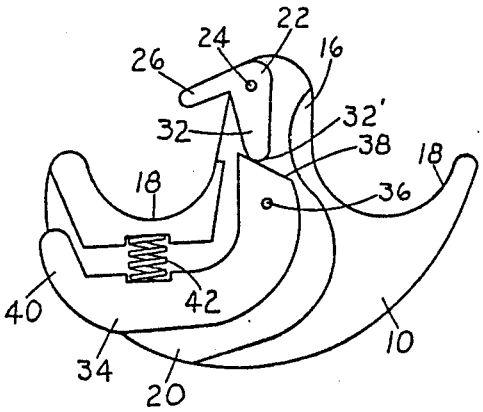
FIG. 1 is a plan view of a simplified form of archery bowstring release embodying the features of this invention, the cover plate being removed to expose internal structural details.
Figure 5:
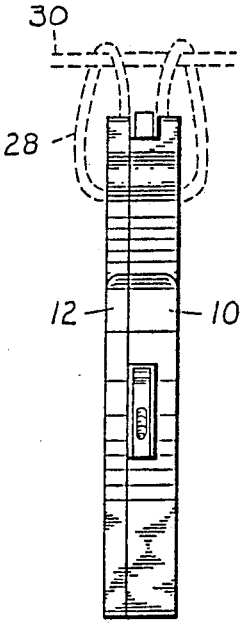
FIG. 5 is a side elevation as viewed from the right in FIG. 4.
Figure 4:
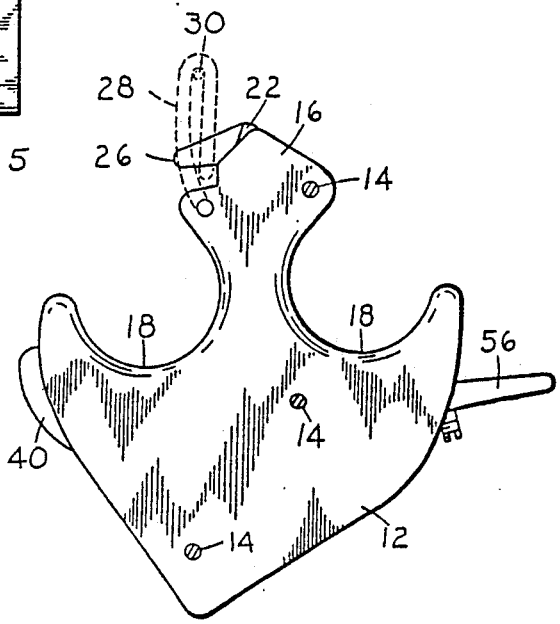
FIG. 4 is a plan view of the release of FIG. 3 with the cover plate installed.

The basic concept of this invention is shown in all of the embodiments illustrated in the drawings. Referring first to FIG. 1, the release is shown to include a two-piece body formed of a cavity section 10 and a cover section 12 (FIGS. 4 and 5). These sections are secured together detachably in registering arrangement by such means as interconnecting screws 14 (FIG. 4).

The body is contoured to provide a central forwardly extending neck 16 and a pair of finger saddles 18 positioned to opposite lateral sides of the neck. The portion of the body extending rearwardly of the saddles is contoured for comfortable reception in the palm of the archer's hand.

The cavity section 10 of the body has an internal cavity 20 which exits the section at the neck 16 and at one side. Within the cavity in the neck there is positioned a hook member 22. It is mounted intermediate its ends on a pivot pin 24 which is secured in registering holes in the cavity and cover sections. One end portion of the hook member extends outwardly through the neck 16 and is configured as a hook 26 for releasable engagement of an archery bowstring or a conventional bowstring retainer loop.

As is well known, and as illustrated in broken lines in FIGS. 4 and 5, a bowstring retainer loop is a length of strong string 28 which is folded to form a loop intermediate its ends, and the terminal ends of the string are secured to the release body. The folded string thus may be passed around a bowstring 30 and the intermediate loop engaged under the hook 26.

The opposite end portion 32 of the hook member 22 extends rearwardly within the neck cavity and forms a bearing surface 32' for releasable engagement with a hook release lever.

In the embodiment of FIG. 1, the hook release lever 34 is mounted pivotally, by pivot pin 36, within the cavity 20. One end 38 of the lever releasably engages the bearing surface 32'. The opposite end of the lever extends outwardly through the end of the cavity which exits the side of the body and provides a thumb piece 40 extending beyond the peripheral margin of the body for releasable engagement by the thumb of an archer's hand.

The hook release lever 34 is biased resiliently for pivotal movement about the axis of pivot pin 36 in the direction to release engagement of the bearing surface 32'. This is provided by the coil power spring 42 interposed between the lever 34 and the cavity section 10 of the body. Such release results in pivoting of the hook member 22 about the axis of pivot pin 24 and consequent release of the archery bowstring, as explained more fully hereinafter.

On the other hand, when the archer's thumb presses against the thumb piece 40 to rotate the lever 34 clockwise about the axis of its pivot pin 36, the hook member 22 is retained in the locked position of FIG. 1 in which the hook 26 is capable of securing an archery bowstring 30 or bowstring retainer loop 28 for pulling the bowstring to full draw.

When the bowstring has been fully drawn and the arrow has been aimed on target, the archer merely relaxes his thumb pressure on the thumb piece 40, allowing the hook release lever 34 to pivot counterclockwise about the axis of pivot pin 36, under the resilient pressure of power spring 42. Since release of the hook 26 is achieved by the power spring 42, rather than by increasing archer finger pressure on a release trigger, as in all known prior art release devices, errors due to human emotions and muscle reactions are minimized.

Figure 2:
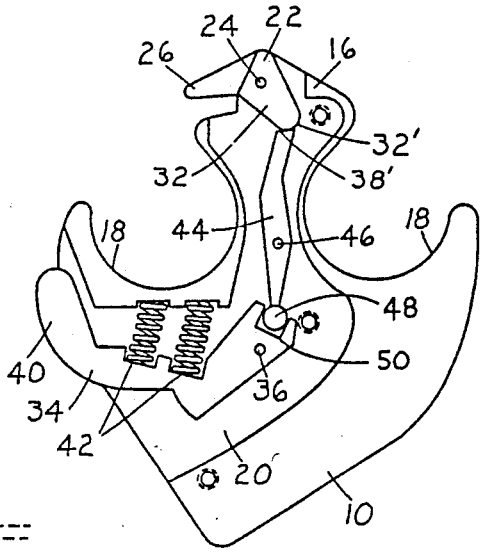
FIG. 2 is a plan view showing a modification of the structural arrangement of FIG. 1 in which a rocker arm is interposed between the hook member and hook release lever.

In the embodiment of FIG. 2, a rocker arm 44 is interposed between the bearing surface 32' of the hook member 22 and the bearing end 38 of the hook release lever 34 of FIG. 1. The rocker arm is mounted in the cavity 20 of the cavity section 10 by pivot pin 46.

A pivot knuckle preferably interconnects the rocker arm and hook release lever. As illustrated, the pivot knuckle is provided by a transverse cylindrical stub shaft 48 on the rocker arm and the adjacent end of the lever 34 is provided with a notch 50 in which the stub shaft is retained for relative pivotal movement.

The rocker arm 44 provides additional mechanical advantage between the thumb piece 40 and the hook member bearing portion 32 to correspondingly increase the sensitivity of hook release control, since it reduces the magnitude of resistive pressure of the thumb piece on the archer's thumb.

It is to be noted that after the hook member 22 has been released, re-setting it to the locked position illustrated in FIGS. 1 and 2 requires the archer to physically rotate the hook member 22 counterclockwise to position the bearing surface 32' inwardly of the end 38 of the lever 34 in FIG. 1 or the corresponding end 38' of rocker arm 44 in FIG. 2, and then rotate the lever 34 clockwise, against the resistance of power spring 42, to position the end 38 or 38' to intercept the bearing surface 32' and thereby secure the hook member 22 in locked position.

Figure 3:
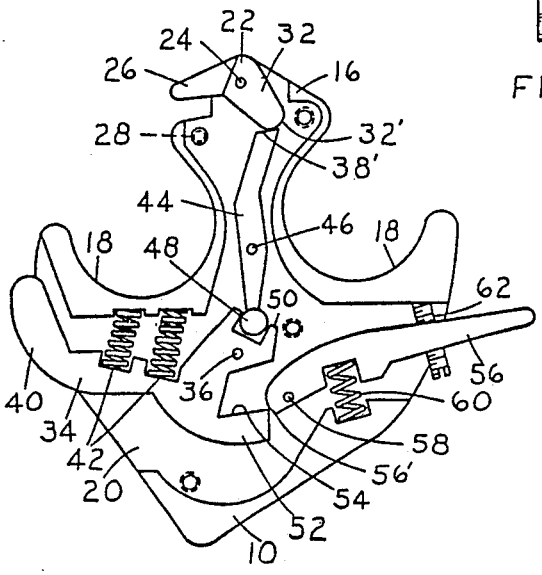
FIG. 3 is a plan view, similar to FIG. 1, showing a form of bowstring release, embodying the features of this invention, which includes a trigger cocking mechanism.

The embodiment illustrated in FIG. 3 provides the hook release lever 34 of FIG. 2 with a second function: namely, as a reset lever to move the rocker arm 44 to the position securing the hook member 22 in locked position. For this purpose, the lever 34 is provided with an extension 52 configured to form a notch 54 between the extension and the lever. The notch is arranged to receive freely therein the inner end portion of trigger lever 56.

The trigger lever 56 is positioned in the cavity 20 which is extended within the section 10 to exit the side of the section opposite the thumb piece 40 of the lever 34. The trigger lever thus is enabled to project outwardly of the body to the side opposite the thumb piece 40 for engagement by a finger of the hand of an archer.

The trigger lever 56 is mounted on pivot pin 58 for pivotal movement, and coil spring 60 is interposed between the trigger lever and body section 10 to urge the trigger lever resiliently in a counterclockwise direction of rotation in FIG. 3. In this position, the inner end 56' of the trigger lever engages the extension 52 and prevents rotation of the hook release lever 34 counterclockwise about the axis of pivot pin 36.

However, when trigger lever 56 is rotated clockwise about the axis of pivot pin 58, the inner end of the trigger lever enters the notch 54, allowing the power springs 42 to rotate the lever 34 counterclockwise about the axis of pivot pin 36. The rocker arm 44 thereby is rotated clockwise about the axis of pivot pin 46 and disengages the bearing end 38' from bearing 32' of hook member 22. The hook member thus is released to pivot freely about pivot pin 24 and disengage the hook 26 from a fully drawn archery bowstring.

A setscrew 62 preferably is mounted in a threaded opening in the trigger lever 56 for engagement with the shoulder defining the cavity 20. The setscrew serves to vary the position of adjustment of the inner end 56' of the trigger lever with the extension 52 of the lever 34. The trigger lever thus may be adjusted to varying magnitudes of movement to the release position, and hence provide a corresponding degree of sensitivity of release relative to the lever 34.

To reset the hook member 22 to locked position, the thumb piece 40 is engaged to rotate the lever 34 clockwise about the axis of its pivot pin 36. As the extension 52 moves away from the inner end 56' of trigger lever 56, spring 60 urges counterclockwise rotation of lever 56 until the inner end 56' disengages from the notch 54 and intercepts the extension 52. The hook release lever 34 thus is secured in cocked position.

As previously mentioned, FIG. 4 shows the embodiment of FIG. 3 with the cover section 12 secured in position by screws 14. FIG. 5 is a view of FIG. 4 from the right side, and shows in broken lines the capture of a bowstring 30 by a conventional bowstring retainer loop 28.

Figure 6:
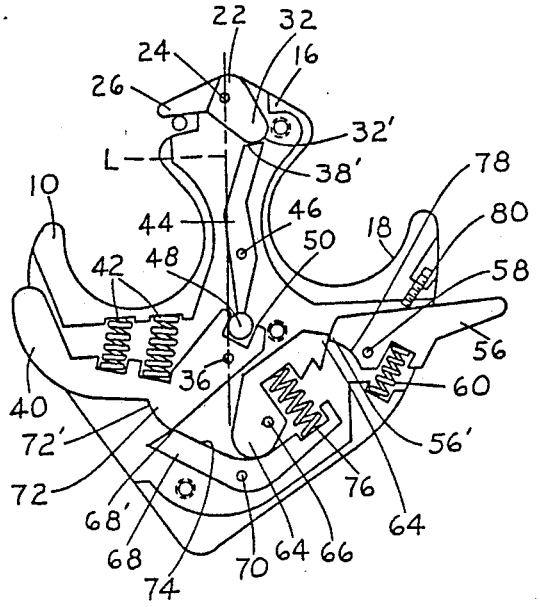
FIG. 6 is a plan view, showing a modification of the FIG. 3 embodiment in which a whisk hammer and fulcrum lever is interposed between the trigger and hook release lever of FIG. 3, the mechanism being shown in cocked position.
Figure 7:
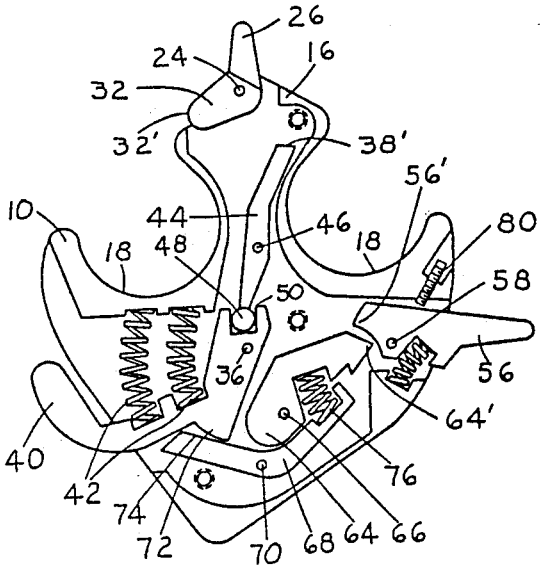
FIG. 7 is a plan view showing the mechanism of FIG. 6 in the triggered position.

FIG. 6 and 7 show the embodiment of FIG. 3 modified to interpose a whisk hammer and fulcrum lever between the trigger lever 56 and the hook release lever 34. Thus, the inner end 56' of the trigger lever 56 releasably engages the adjacent end 64' of whisk hammer 64. The whisk hammer is mounted intermediate its ends on pivot pin 66.

The fulcrum lever 68 is mounted intermediate its ends on pivot pin 70. A rounded end 68' of the fulcrum lever is located adjacent the hook release lever 34. An offset cam portion 72 of the lever 34 is provided with a cam surface 72' positioned to slidably engage the rounded end 68' and also an edge surface 74 of the fulcrum lever (FIG. 7). When the cam surface 72' engages the edge surface 74 and the lever 34 is rotated clockwise, (from FIG. 7 to FIG. 6) the fulcrum lever is rotated slightly clockwise about the axis of its pivot pin 70 until the cam portion 72 passes beyond the rounded end 68' of the fulcrum lever.

A coil spring 76 is interposed between the whisk hammer 64 and fulcrum lever 68 in position to urge them apart. Thus, when the cam portion 72 passes beyond the end 68' of the fulcrum lever, the coil spring 76 urges the fulcrum lever to rotate clockwise about the axis of its pivot pin 70 to position the rounded end 68' to engage the cam portion 72 (FIG. 6). The hook release lever 34 thereby is retained in cocked position.

It is to be noted in FIG. 6 that the pivot pin 46 and bearing engaging end 38' of rocker arm 44 are displaced to one side of a line L through the axes of pivot pins 24 and 36. This arrangement maintains the force of hook member 22 on the pivot pin 46 throughout bowstring draw.

With the fulcrum lever 68 retaining the lever 34 in cocked position (FIG. 6), the fulcrum lever and coil spring 76 also urge the whisk hammer 64 to rotate counterclockwise about the axis of its pivot pin 66. During this movement the said adjacent end 64' of the whisk hammer slidably engages an edge portion 78 of the trigger lever 56 and pivots the latter clockwise about the axis of its pivot pin 58, against the resilient resistance of coil spring 60. When the end 64' of the whisk hammer passes beyond the end 56' of the trigger lever, the coil spring 60 rotates the trigger lever counterclockwise to bring the ends 56' and 64' into mutual engagement. The trigger lever 56 thus is retained in cocked position.

An adjustable setscrew 80 is threaded through a tapped bore in the cavity section 10 for engagement of its inner end with the trigger lever 56. Adjustment of the setscrew thus affords a range of adjustment of release sensitivity of the trigger lever, by varying the magnitude of movement of the trigger lever.

In the operation of the release embodiment of FIGS. 6 and 7, let it be assumed that the assembly is in the cocked position of FIG. 6 and that a bowstring 30 or bowstring retainer loop 28 is held behind the hook 26. Slight finger pressure on the exposed portion of trigger lever 56 causes the latter to rotate clockwise to disengage the inner end 56' from the end 64' of the whisk hammer 64. The greater force of power springs 42, relative to coil spring 76, causes the hook release lever 34 to rotate counterclockwise about the axis of its pivot pin 36 to release the hook member 22 and archery bowstring, as previously described. As the hook release lever 34 rotates counterclockwise, the cam surface 72' slides along edge 74 to rotate the fulcrum lever 68 counterclockwise to the position shown in FIG. 7. This counterclockwise movement of the fulcrum lever causes clockwise rotation of whisk hammer 64 and consequent compression of spring 76, also as shown in FIG. 7.

To reset the release to cocked position, thumb pressure on the thumb piece 40 to rotate the lever 34 clockwise results in cam surface 72' sliding along edge surface 74 and in fulcrum lever 68 rotating slightly clockwise, assisted by extension of spring 76. Cam surface 72' slides from edge 74 to rounded edge 68', spring 76 causing further clockwise rotation of fulcrum lever 68. This clockwise movement of the fulcrum lever causes the whisk hammer 64 to be rotated counterclockwise by extension of spring 76. The end 64' slides along the edge portion 78 of the trigger lever 56 and rotates the latter clockwise about the axis of its pivot pin 58. When the end 64' of the whisk hammer passes beyond the end 56' of the trigger lever the coil spring 60 causes the trigger lever to rotate counterclockwise into engagement with setscrew 80. The end 56' of the trigger lever also engages the end 64' of the whisk hammer, whereby the trigger lever is retained in cocked position.

Figure 8:
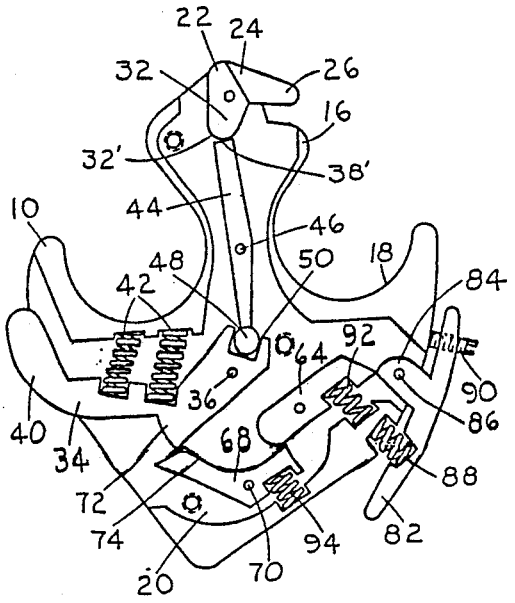
FIG. 8 is a plan view showing a modified form of trigger for the mechanism of FIG. 6.

FIG. 8 shows a modified arrangement for the trigger lever 56 of FIG. 6. In this modification the trigger lever 82 is positioned on the outer side of the release body and an intermediate lug 84 rojects into the cavity 20 for pivotal mounting on pivot pin 86. A coil spring 88 is interposed between the cavity section 10 and trigger lever 82, and a sensitivity adjustment setscrew 90 on the lever is arranged for abutment with the outer surface of the cavity section.

A coil spring 92 is interposed between the whisk hammer 64 and the cavity section 10, and another coil spring 94 is interposed between the fulcrum lever 68 and the cavity section. The operation of this arrangement is the same as that of FIG. 6.

Figure 9:
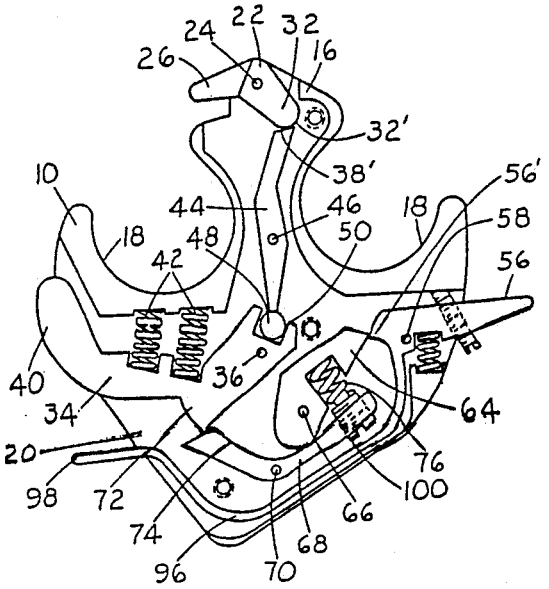
FIG. 9 is a plan view showing a tension adjustment for the spring between the whisk hammer and fulcrum lever and a thumb trigger extension of the finger trigger of FIG. 6.

FIG. 9 shows a modification of FIG. 6 in the provision of an extension 96 of trigger lever 56 passing through the cavity 20 and exiting the latter adjacent the thumb piece 40. The extension terminates outwardly of the body in a thumb trigger 98. This allows operation of the release either by the finger trigger 56 or by the thumb trigger 98.

In addition, there is provided an adjustment screw 100 in the fulcrum lever 68 engaging the coil spring 76. The screw is adjustable to vary the tension of the spring and thereby vary the load or resistive pressure applied to the trigger lever.

The release sensitivity of the trigger lever 56 thus may be controlled by the setscrew 80 which adjusts the degree of movement of the trigger lever, and/or by the adjustment screw 100 which adjusts resistive pressure applied against the trigger lever by the whisk hammer 64. These two adjustments allows the trigger lever to have a long stroke at very low resistive pressure, whereby to substantially eliminate any shear point feel at the engaging ends 56' and 64'.

Figure 10:
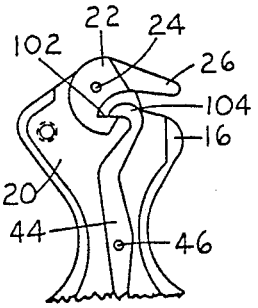
FIG. 10 is a fragmentary plan view showing an alternative form of rocker arm engagement with the string retainer hook.

FIG. 10 shows an alternative interengagement between the hook member 22 and rocker arm 44 in which the hook member is provided with a latch notch 102 and the rocker arm is provided with a latch hook 104 arranged to releasably engage the latch notch.

It will be apparent to those skilled in the art that various modifications and changes in the size, shape, type, number and arrangement of parts described hereinbefore, may be made without departing from the spirit of this invention and the scope of the appended claims.

I claim:

1. An archery bowstring release, comprising:

(a) a body having a peripheral margin (b) a hook member mounted pivotally on the body, the hook member having a hook configured for engagement by a bowstring or a bowstring retainer loop, (c) a hook release lever mounted pivotally on the body for movement between a locking position in which the lever secures the hook member in locked position for retaining a bowstring or bowstring retainer loop preparatory to pulling the bowstring to draw position, and a release position in which the lever releases the hook member for rotation to release the bowstring or bowstring retainer loop from draw position, (d) spring means interposed between the body and hook release lever for urging the hook release lever resiliently toward said release position, (e) a trigger lever mounted pivotally on the body for movement between a cocked position securing the hook release lever in said hook locking position and a triggered position releasing the hook release lever for movement by the spring means to said hook release position, the trigger lever extending laterally beyond the peripheral margin of the body for manipulation by a hand of an archer, and (f) spring means interposed between the trigger lever and body for resiliently urging the trigger lever to said cocked position.

2. The archery bowstring release of claim 1 including a trigger extension on the trigger lever extending beyond the peripheral margin of the body opposite said trigger lever for manipulation by ah and of an archer.

3. An archery bowstring release, comprising:

(a) a body, (b) a hook member mounted pivotally on the body, the hook member having a hook configured for engagement by a bowstring or a bowstring retainer loop, (c) a hook release lever mounted pivotally on the body, (d) a rocker arm mounted on the body and having one end engaging the hook member, coupling means interconnecting the opposite end of the rocker arm and the hook release lever, the rocker arm being movable by the coupled hook release lever between a hook locking position in which the rocker arm secures the hook member in locked position for retaining the bowstring or bowstring retainer loop preparatory to pulling the bowstring to draw position, and a hook releasing position in which the rocker arm releases the hook member for rotation to release the bowstring or bowstring retainer loop from draw position, and (e) spring means interposed between the body and hook release lever for urging the hook release lever and coupled rocker arm resiliently toward said hook releasing position.

4. The archery bowstring release of claim 3 wherein the coupling means includes pivot means interengaging the rocker arm and hook release lever.

5. The archery bowstring release of claim 3 wherein the hook member is provided with a latch notch and the rocker arm is provided with a reversely bent latch hook arranged to releasably engage the latch notch.

6. An archery bowstring release, comprising:

(a) a body having a peripheral margin, (b) a hook member mounted pivotally on the body, the hook member having a hook configured for engagement by a bowstring or a bowstring retainer loop, (c) a hook release lever mounted pivotally on the body for movement between a locking position in which the lever secures the hook member in locked position for retaining a bowstring or bowstring retainer loop preparatory to pulling the bowstring to draw position, and a release position in which the lever releases the hook member for rotation to release the bowstring or bowstring retainer loop from draw position, (d) spring means interposed between the body and hook release lever for urging the hook release lever resiliently toward said release position, (e) a trigger lever mounted pivotally on the body for movement between a cocked position securing the hook release lever in said hooked locking position and a triggered position releasing the hook release lever for movement by the spring means to said hook release position, the trigger lever extending laterally beyond the peripheral margin of the body for manipulation by a hand of an archer, (f) spring means interposed between the trigger lever and body for resiliently urging the trigger lever to said cocked position, (g) a whisk hammer mounted pivotally on the body for movement between a trigger latching position releasably latching the trigger lever in cocking position and a trigger release position disengaged from said trigger lever, (h) spring means engaging the whisk hammer for urging the whisk hammer resiliently toward said trigger latching position, (i) a fulcrum lever mounted pivotally on the body for movement between a hook release lever latching position releasably latching the hook release lever in said locked position and a hook release lever release position, and (j) spring means engaging the fulcrum lever for urging the fulcrum lever toward said hook release lever latching position, (k) the fulcrum lever being configured for movement by the hook release lever during movement of the latter to said release position in the direction to move the whisk hammer to said trigger latching position, (l) the spring means interposed between the body and hook release lever being stronger than the spring means engaging the fulcrum lever, whereby to effect said movement of the fulcrum lever to move said whisk hammer to said trigger latching position.

7. The archery bowstring release of claim 6 including adjustment means engaging the spring means engaging the fulcrum lever for varying the tension of said spring means.

8. An archery bowstring release, comprising:

(a) a body having a peripheral margin, (b) a hook member mounted pivotally on the body, the hook member having a hook configured for engagement by a bowstring or a bowstring retainer loop, (c) a hook release lever mounted pivotally on the body for movement between a locking position in which the lever secures the hook member in locked position for retaining a bowstring or bowstring retainer loop preparatory to pulling the bowstring to draw position, and a release position in which the lever releases the hook member for rotation to release the bowstring or bowstring retainer loop from draw position, (d) spring means interposed between the body and hook release lever for urging the hook release lever resiliently toward said release position, (e) a trigger lever mounted pivotally on the body for movement between a cocked position securing the hook release lever in said hooked locking position and a triggered position releasing the hook release lever for movement by the spring means to said hook release position, the trigger lever extending laterally beyond the peripheral margin of the body for manipulation by a hand of an archer, (f) spring means interposed between the trigger lever and body for resiliently urging the trigger lever to said cocked position, (g) a whisk hammer mounted pivotally on the body for movement between a trigger latching position releasably latching the trigger lever in cocking position and a trigger release position disengaged from said trigger lever, (h) a fulcrum lever mounted pivotally on the body for movement between a hook release lever latching position releasably latching the hook release lever in said locked position and a hook release lever release position, and (i) spring means interposed between the whisk hammer and fulcrum lever for applying resistive pressure to the trigger lever, (j) the fulcrum lever being configured for movement by the hook release lever during movement of the latter to said release position in the direction to move the whisk hammer to said trigger latching position, (k) the spring means interposed between the body and hook release lever being stronger than the spring means engaging the fulcrum lever, whereby to effect said movement of the fulcrum lever to move said whisk hammer to said trigger latching position.

9. The archery bowstring release of claim 8 including adjustment means engaging the spring means between the whisk hammer and fulcrum lever for varying the tension of said spring means.

10. The archery bowstring release of claim 9 wherein the adjustment means includes a screw threaded to the fulcrum lever and engaging one end of the spring means between the whisk hammer and the fulcrum lever, the screw being movable toward and away from the spring means for varying the tension of the latter.

* * * * *